US009715819B1

(12) United States Patent
Stockdale

(10) Patent No.: US 9,715,819 B1
(45) Date of Patent: Jul. 25, 2017

(54) EMERGENCY ALERT ASSEMBLY

(71) Applicant: Cindy Stockdale, Nottingham, MD (US)

(72) Inventor: Cindy Stockdale, Nottingham, MD (US)

( * ) Notice: Subject to any disclaimer, the term of this patent is extended or adjusted under 35 U.S.C. 154(b) by 0 days.

(21) Appl. No.: 15/153,853

(22) Filed: May 13, 2016

(51) Int. Cl.

| | |
|---|---|
| ***G08B 1/08*** | (2006.01) |
| ***G08B 25/01*** | (2006.01) |
| ***G08B 25/10*** | (2006.01) |
| ***G08B 15/00*** | (2006.01) |
| ***G08B 21/02*** | (2006.01) |

(52) U.S. Cl.
CPC ..... *G08B 25/016* (2013.01); *G08B 15/004* (2013.01); *G08B 21/0269* (2013.01); *G08B 25/10* (2013.01)

(58) Field of Classification Search
CPC ..... G08B 21/0269; G08B 21/0283; G08B 21/0288; G08B 21/04; G08B 21/22; G08B 25/016; G08B 25/006; G08B 25/10; G08B 21/02; G08B 21/272; G08B 15/004; Y10T 24/4782; Y10T 70/40; Y10T 70/8459; H04W 76/007
USPC ... 340/539.13, 573.4, 539.15, 539.1, 539.11; 368/14, 243, 327; 455/404.1, 404.2
See application file for complete search history.

(56) References Cited

U.S. PATENT DOCUMENTS

| | | | | |
|---|---|---|---|---|
| 4,587,516 | A | 5/1986 | Hiraki | |
| 5,005,002 | A | 4/1991 | Halperin | |
| 5,923,253 | A | 7/1999 | Anastasiou | |
| D451,417 | S | 12/2001 | Simu-Brown | |
| 7,231,200 | B2 | 6/2007 | Jenkins | |
| 2001/0055243 | A1* | 12/2001 | Haywood | G01S 5/02 368/10 |
| 2007/0182548 | A1* | 8/2007 | Raad | G08B 25/009 340/539.13 |
| 2008/0182547 | A1 | 7/2008 | Glover | |
| 2011/0319048 | A1* | 12/2011 | Matlock | G08B 25/006 455/404.1 |
| 2012/0223834 | A1* | 9/2012 | Hyatt | G08B 21/0247 340/539.13 |
| 2013/0069766 | A1 | 3/2013 | Sorge | |

FOREIGN PATENT DOCUMENTS

| | | |
|---|---|---|
| WO | WO2009109642 | 9/2009 |

* cited by examiner

*Primary Examiner* — Anh V La

(57) ABSTRACT

A emergency alert assembly includes a band that may be worn around a hand of a user. A communication unit is coupled to the band and the communication unit may be selectively manipulated. The communication unit may be in electrical communication with an extrinsic communications network. Thus, the communication unit may selectively contact an emergency response. The communication unit may be in electrical communication with a global positioning satellite. Thus, the communication unit may communicate a physical location of the band to the emergency response.

6 Claims, 3 Drawing Sheets

EMERGENCY ALERT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to alert devices and more particularly pertains to a new alert device for selectively alerting an emergency response.

BRIEF SUMMARY OF THE INVENTION

An embodiment of the disclosure meets the needs presented above by generally comprising a band that may be worn around a hand of a user. A communication unit is coupled to the band and the communication unit may be selectively manipulated. The communication unit may be in electrical communication with an extrinsic communications network. Thus, the communication unit may selectively contact an emergency response. The communication unit may be in electrical communication with a global positioning satellite. Thus, the communication unit may communicate a physical location of the band to the emergency response.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
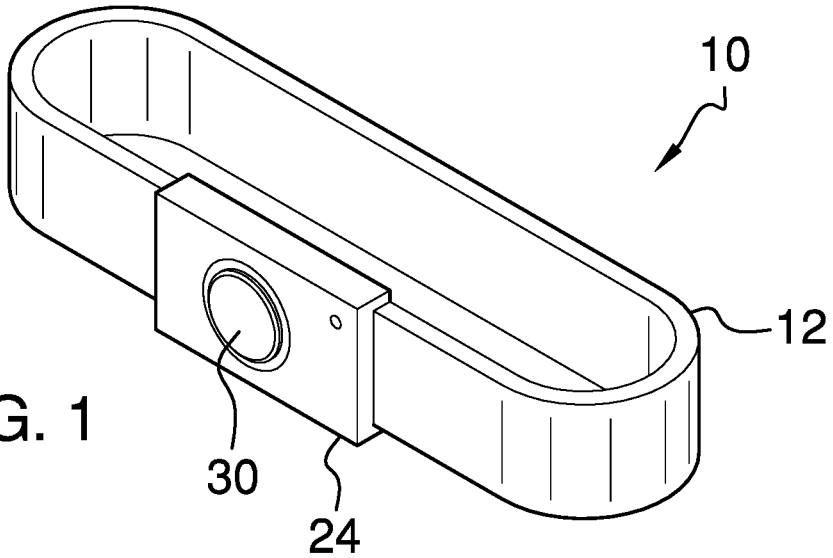
FIG. 1 is a perspective view of a emergency alert assembly according to an embodiment of the disclosure.
Figure 2:
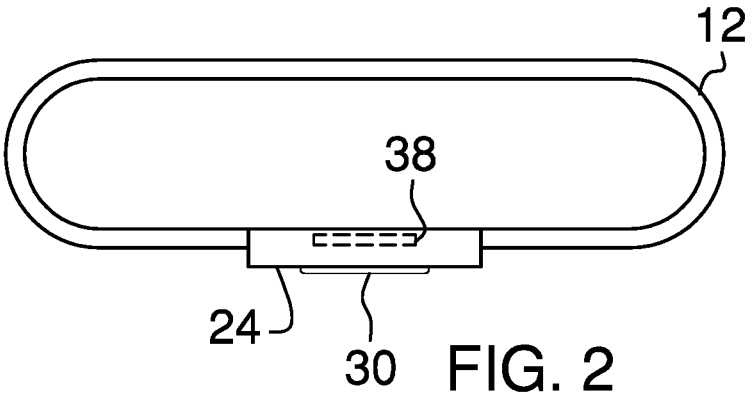
FIG. 2 is a top view of an embodiment of the disclosure.
Figure 3:
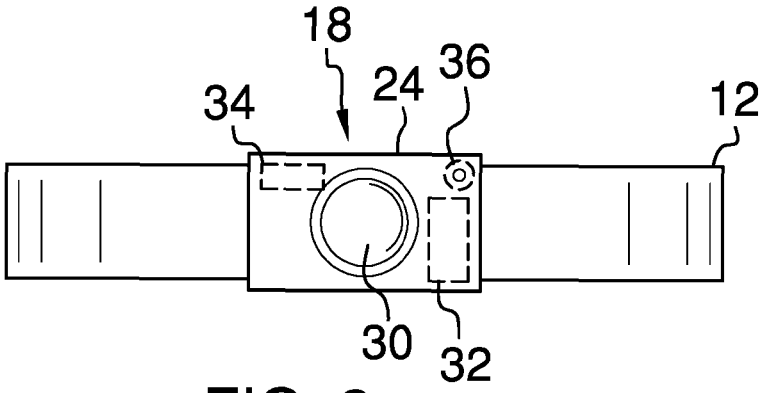
FIG. 3 is a front view of an embodiment of the disclosure.
Figure 4:
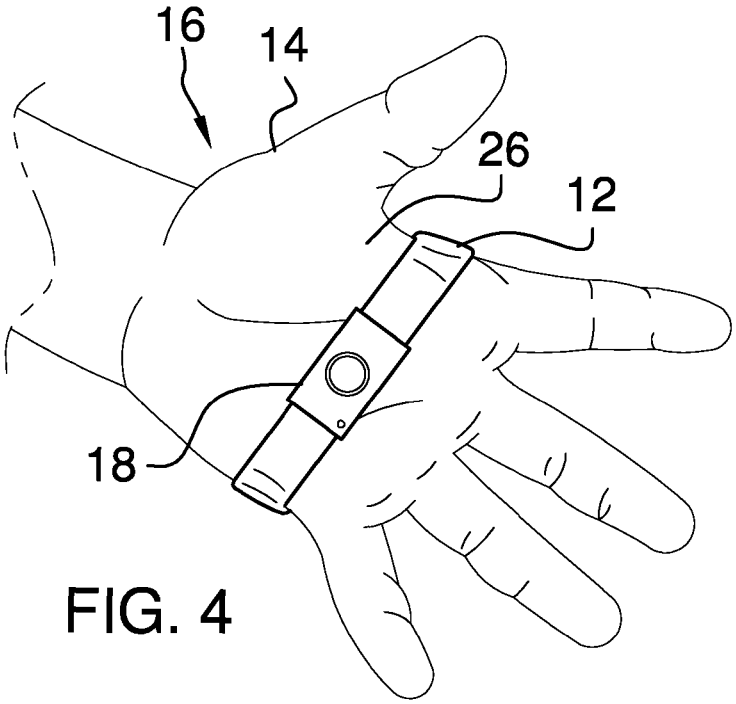
FIG. 4 is a perspective in-use view of an embodiment of the disclosure.
Figure 5:
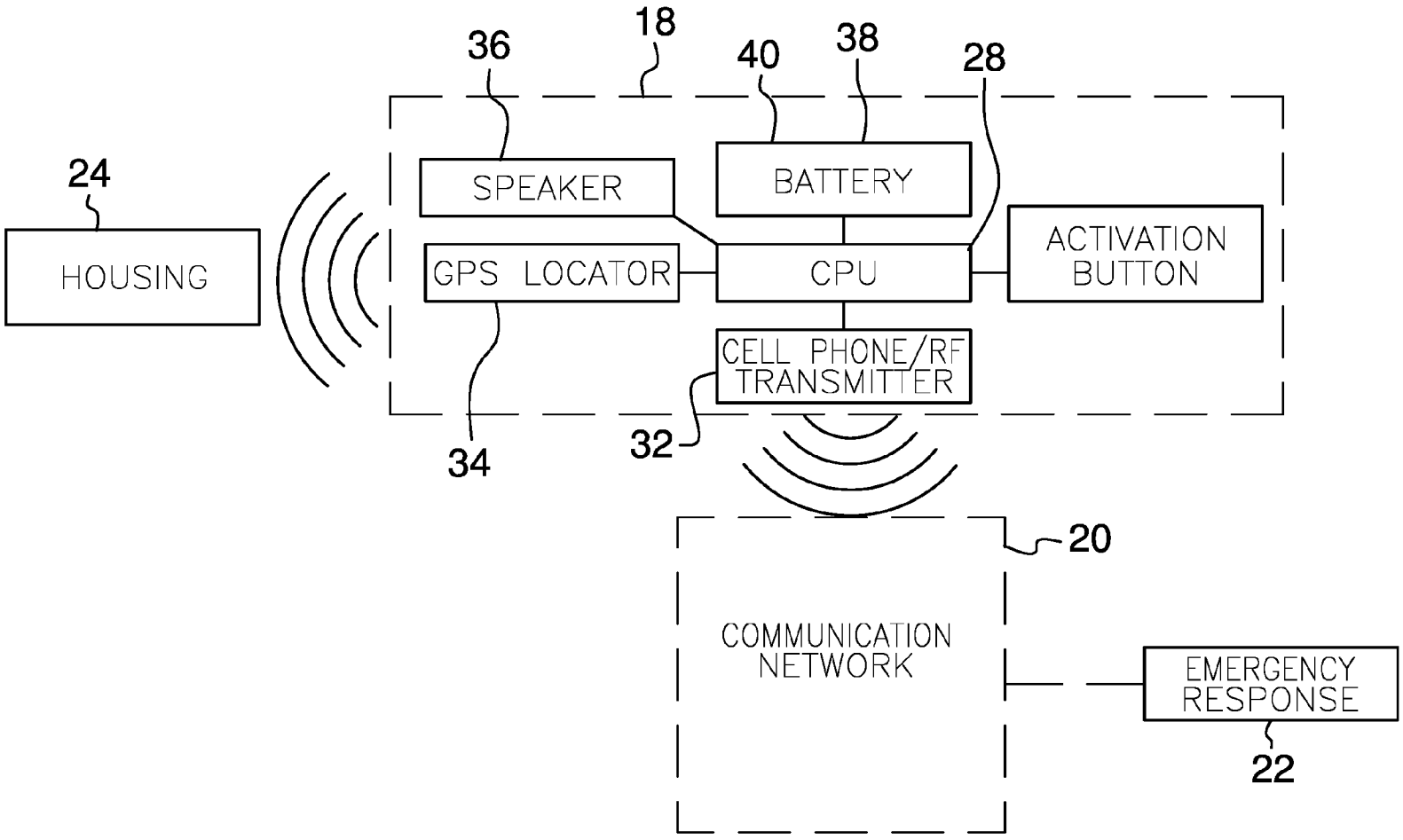
FIG. 5 is a schematic view of an embodiment of the disclosure.

With reference now to the drawings, and in particular to FIGS. 1 through 5 thereof, a new alert device embodying the principles and concepts of an embodiment of the disclosure and generally designated by the reference numeral 10 will be described.

As best illustrated in FIGS. 1 through 5, the emergency alert assembly 10 generally comprises a band 12 that may be worn around a hand 14 of a user 16. A communication unit 18 is coupled to the band 12 and the communication unit 18 may be selectively manipulated. Moreover, the communication unit 18 is in electrical communication with an extrinsic communications network 20. Thus, the communication unit 18 may selectively contact an emergency response 22. The emergency response 22 may comprise 911 or the like. The communication unit 18 is in electrical communication with a global positioning satellite 24. Thus, the communication unit 18 may communicate a physical location of the band 12 to the emergency response 22.

The communication unit 18 comprises a housing 24 that is coupled to the band 12. The housing 24 may be positioned on a palm 26 of the user 16 when the band 12 is worn. A processor 28 is positioned within the housing 24 and the processor 28 selectively generates an alarm sequence. The processor 28 may comprise an electronic processor or the like. A button 30 is movably coupled to the housing 24 and the button 30 may be selectively manipulated. The button 30 is electrically coupled to the processor 28. The processor 28 generates the alarm sequence when the button 30 is manipulated.

A transmitter 32 is positioned within the housing 24 and the transmitter 32 is electrically coupled to the processor 28. The transmitter 32 may be in electrical communication with the extrinsic communications network 20. The transmitter 32 may contact the emergency response 22 when the processor 28 generates the alarm sequence. Thus, the transmitter 32 may alert the emergency response 22 that the user 16 is in distress. The transmitter 32 may comprise a radio frequency transmitter or the like.

A gps receiver 34 is positioned within the housing 24 and the gps receiver 34 is electrically coupled to the processor 28. The gps receiver 34 is in electrical communication with the global positioning satellite 24. Thus, the gps receiver 34 may establish a physical location of the band 12. The transmitter 32 communicates the physical location of the band 12 to the emergency response 22 when the processor 28 generates the alarm sequence.

A speaker 36 is coupled to the housing 24. The speaker 36 may emit an audible alarm. The speaker 36 is electrically coupled to the processor 28. The speaker 36 emits the audible alarm when the processor 28 generates the alarm sequence. Thus, the speaker 36 may alert an observer that the user 16 is in distress.

A power supply 38 is provided. The power supply 38 is positioned within the housing 24. The power supply 38 is electrically coupled to the processor 28. The power supply 38 comprises at least one battery 40.

In use, the band 12 is worn on the user's hand 14. The band 12 is manipulated to position the housing 24 on the user's palm 26. The user 16 manipulates the button 30 when the user 16 is distressed. The distress may result from physical attack in an outdoor location, a physical injury or other emergency. The transmitter 32 contacts the emergency response 22 and alerts the emergency response 22 to the user's 16 distress. The transmitter 32 communicates the physical location of the band 12 to the emergency response 22. Thus, the emergency response 22 is facilitated to respond to the user's 16 distress.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An emergency alert assembly comprising:

a band being configured to be worn around a hand of a user; and a communication unit being coupled to said band wherein said communication unit is configured to be selectively manipulated, said communication unit being configured to be in electrical communication with an extrinsic communications network thereby facilitating said communication unit to selectively contact an emergency response, said communication unit being configured to be in electrical communication with a global positioning satellite thereby facilitating said communication unit to communicate a physical location of said band to the emergency response, said communication unit comprising a housing being coupled to said band, said housing being configured to be positioned on a palm of the user when said band is worn, said housing having a first face positioned flush with said band, said housing having a second face opposite said first face, said second face being offset from said band such that said housing extends outwardly from said band, a processor being positioned within said housing, said processor selectively generating an alarm sequence, and a button being movably coupled to said housing wherein said button is configured to be selectively manipulated, said button being electrically coupled to said processor, said processor generating said alarm sequence when said button is manipulated, said button having a distal face relative to said band, said distal face being positioned in outwardly spaced relationship to said second face of said housing wherein said button protrudes from said second face of said housing.

2. The assembly according to claim 1, further comprising a transmitter being positioned within said housing, said transmitter being electrically coupled to said processor, said transmitter being configured to be in electrical communication with the extrinsic communications network, said transmitter being configured to contact the emergency response when said processor generates said alarm sequence.

3. The assembly according to claim 1, further comprising a gps receiver being positioned within said housing, said gps receiver being electrically coupled to said processor, said gps receiver being configured to be in electrical communication with the global positioning satellite thereby facilitating said gps receiver to establish a physical location of said band, said transmitter being configured to communicate the physical location of said band to the emergency response when said processor generates said alarm sequence.

4. The assembly according to claim 1, further comprising a speaker being coupled to said housing wherein said speaker is configured to emit an audible alarm, said speaker being electrically coupled to said processor wherein said speaker is configured to emit the audible alarm when said processor generates said alarm sequence.

5. The assembly according to claim 1, further comprising a power supply being positioned within said housing, said power supply being electrically coupled to said processor, said power supply comprising at least one battery.

6. An emergency alert assembly comprising:

a band being configured to be worn around a hand of a user; and a communication unit being coupled to said band wherein said communication unit is configured to be selectively manipulated, said communication unit being configured to be in electrical communication with an extrinsic communications network thereby facilitating said communication unit to selectively contact an emergency response, said communication unit being configured to be in electrical communication with a global positioning satellite thereby facilitating said communication unit to communicate a physical location of said band to the emergency response, said communication unit comprising:

a housing being coupled to said band, said housing being configured to be positioned on a palm of the user when said band is worn, said housing having a first face positioned flush with said band, said housing having a second face opposite said first face, said second face being offset from said band such that said housing extends outwardly from said band, a processor being positioned within said housing, said processor selectively generating an alarm sequence, a button being movably coupled to said housing wherein said button is configured to be selectively manipulated, said button having a distal face relative to said band, said distal face being positioned in outwardly spaced relationship to said second face of said housing wherein said button protrudes from said second face of said housing, said button being electrically coupled to said processor, said processor generating said alarm sequence when said button is manipulated, a transmitter being positioned within said housing, said transmitter being electrically coupled to said processor, said transmitter being configured to be in electrical communication with the extrinsic communications network, said transmitter being configured to contact the emergency response when said processor generates said alarm sequence, a gps receiver being positioned within said housing, said gps receiver being electrically coupled to said processor, said gps receiver being configured to be in electrical communication with the global positioning satellite thereby facilitating said gps receiver to establish a physical location of said band, said transmitter being configured to communicate the physical location of said band to the emergency response when said processor generates said alarm sequence, a speaker being coupled to said housing wherein said speaker is configured to emit an audible alarm, said speaker being electrically coupled to said processor wherein said speaker is configured to emit the audible alarm when said processor generates said alarm sequence, and a power supply being positioned within said housing, said power supply being electrically coupled to said processor, said power supply comprising at least one battery.

* * * * *